US009091012B2

(12) United States Patent
Ashrafzadeh et al.

(10) Patent No.: US 9,091,012 B2
(45) Date of Patent: Jul. 28, 2015

(54) METHOD AND APPARATUS FOR DETERMINING AN INERTIA OF A LAUNDRY LOAD IN A LAUNDRY TREATING APPLIANCE

(75) Inventors: Farhad Ashrafzadeh, Stevensville, MI (US); Brian P. Janke, Saint Joseph, MI (US); Peter E. Zasowski, Yantis, TX (US)

(73) Assignee: Whirlpool Corporation, Benton Harbor, MI (US)

( * ) Notice: Subject to any disclaimer, the term of this patent is extended or adjusted under 35 U.S.C. 154(b) by 343 days.

(21) Appl. No.: 13/469,132

(22) Filed: May 11, 2012

(65) Prior Publication Data

US 2013/0160220 A1 Jun. 27, 2013

Related U.S. Application Data

(60) Provisional application No. 61/578,925, filed on Dec. 22, 2011.

(51) Int. Cl.

| | |
|---|---|
| ***D06F 33/02*** | (2006.01) |
| ***D06F 37/02*** | (2006.01) |
| ***D06L 1/00*** | (2006.01) |

(52) U.S. Cl.

CPC ..... *D06F 33/02* (2013.01); *D06F 2202/065* (2013.01); *D06F 2202/08* (2013.01); *D06F 2202/10* (2013.01); *D06F 2202/12* (2013.01); *D06F 2204/065* (2013.01)

(58) Field of Classification Search

CPC ..... D06F 33/02; D06F 2202/065; D06F 2204/065; D06F 2202/10; D06F 2202/12; D06F 2202/08

USPC ..... 8/157, 158, 159

See application file for complete search history.

(56) References Cited

U.S. PATENT DOCUMENTS

| | | | | |
|---|---|---|---|---|
| 4,607,408 | A | 8/1986 | Didier et al. | |
| 4,782,544 | A | 11/1988 | Nystuen et al. | |
| 5,507,054 | A | 4/1996 | Blauert et al. | |
| 6,505,369 | B1 | 1/2003 | Weinmann | |
| 7,739,764 | B2 | 6/2010 | Zhang et al. | |
| 2001/0054204 | A1 * | 12/2001 | Ciancimino et al. | 8/159 |
| 2003/0000262 | A1 * | 1/2003 | Bruce et al. | 68/12.06 |
| 2006/0242768 | A1 * | 11/2006 | Zhang et al. | 8/159 |
| 2007/0039105 | A1 * | 2/2007 | Lee et al. | 8/158 |
| 2007/0151041 | A1 * | 7/2007 | McAllister et al. | 8/149.2 |
| 2009/0199598 | A1 * | 8/2009 | Kanazawa | 68/12.04 |
| 2009/0288260 | A1 * | 11/2009 | Jurmann | 8/159 |
| 2011/0005339 | A1 | 1/2011 | Ashrafzadeh et al. | |

FOREIGN PATENT DOCUMENTS

| | | | |
|---|---|---|---|
| DE | 4431846 | A1 | 3/1996 |
| EP | 0345120 | B1 | 12/1989 |
| EP | 1342826 | A1 | 9/2003 |
| EP | 2148430 | A1 | 1/2010 |
| EP | 2377982 | A1 | 10/2011 |

OTHER PUBLICATIONS

European Search Report for Corresponding EP12197598.1, May 11, 2015.

* cited by examiner

*Primary Examiner* — Michael Barr
*Assistant Examiner* — Benjamin L Osterhout

(57) ABSTRACT

An apparatus and method for determining an inertia of a laundry load for a laundry treating appliance during an acceleration phase.

15 Claims, 3 Drawing Sheets

METHOD AND APPARATUS FOR DETERMINING AN INERTIA OF A LAUNDRY LOAD IN A LAUNDRY TREATING APPLIANCE

CROSS REFERENCE TO RELATED APPLICATIONS

The present application claims the benefit of U.S. Provisional Patent Application No. 61/578,925, filed Dec. 22, 2011, which is incorporated herein by reference in its entirety.

BACKGROUND OF THE INVENTION

Laundry treating appliances, such as a washing machine, may include a drum defining a treating chamber for receiving and treating a laundry load according to a cycle of operation. The cycle of operation may include a phase during which the liquid may be removed from the laundry load, an example of which is an extraction phase where a drum holding the laundry rotates at speeds high enough to impart a sufficient centrifugal force on the laundry load to remove the liquid.

During the extraction phase, the laundry load is satellized by centrifugal force and rotates with the drum and exerts a force on the drum. If a sufficiently large force is exerted on the drum, a large enough hoop stress may be created on the drum and the drum may be damaged. A current solution to ensure a large enough hoop stress is not encountered is to set a maximum rotational speed that is set based on a maximum laundry load condition, not the actual laundry load condition.

SUMMARY OF THE INVENTION

The invention relates to a method of operating a laundry treating appliance having a rotatable drum at least partially defining a treating chamber, and a motor rotating the drum by rotating the drum according to a speed profile including an acceleration phase, and repeatedly determining the inertia of the laundry load during the acceleration phase.

DESCRIPTION OF AN EMBODIMENT OF THE INVENTION

Figure 1:
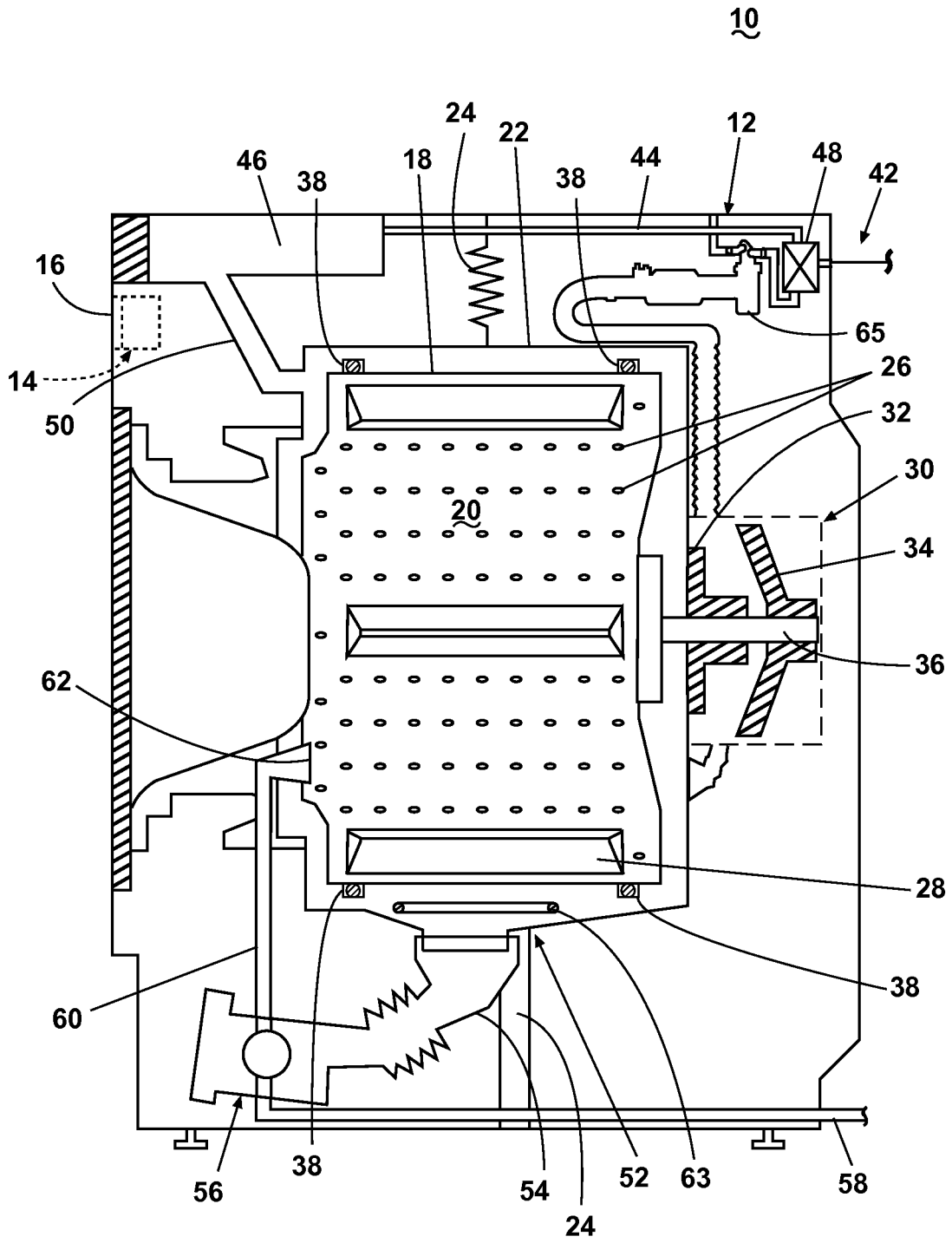
FIG. 1 is a schematic, cross-sectional view of a laundry treating appliance in the form of a horizontal axis washing machine according to one embodiment of the invention.

FIG. 1 is a schematic, cross-sectional view of a laundry treating appliance in the form of a horizontal axis washing machine 10 according to one embodiment of the invention. While the laundry treating appliance is illustrated as a horizontal axis washing machine 10, the laundry treating appliance according to the invention may be any machine that treats articles such as clothing or fabrics. Non-limiting examples of the laundry treating appliance may include a front loading/horizontal axis washing machine; a top loading/vertical axis washing machine; a combination washing machine and dryer; an automatic dryer; a tumbling or stationary refreshing/revitalizing machine; an extractor; a non-aqueous washing apparatus; and a revitalizing machine. The washing machine 10 described herein shares many features of a traditional automatic washing machine, which will not be described in detail except as necessary for a complete understanding of the invention.

Washing machines are typically categorized as either a vertical axis washing machine or a horizontal axis washing machine. As used herein, the "vertical axis" washing machine refers to a washing machine having a rotatable drum, perforate or imperforate, that holds fabric items and a clothes mover, such as an agitator, impeller, nutator, and the like within the drum. The clothes mover moves within the drum to impart mechanical energy directly to the clothes or indirectly through liquid in the drum. The liquid may include one of wash liquid and rinse liquid. The wash liquid may have at least one of water and a wash aid. Similarly, the rinse liquid may have at least one of water and a rinse aid. The clothes mover may typically be moved in a reciprocating rotational movement. In some vertical axis washing machines, the drum rotates about a vertical axis generally perpendicular to a surface that supports the washing machine. However, the rotational axis need not be vertical. The drum may rotate about an axis inclined relative to the vertical axis. As used herein, the "horizontal axis" washing machine refers to a washing machine having a rotatable drum, perforated or imperforated, that holds fabric items and washes the fabric items by rubbing against one another as the drum rotates. In some horizontal axis washing machines, the drum rotates about a horizontal axis generally parallel to a surface that supports the washing machine. However, the rotational axis need not be horizontal. The drum may rotate about an axis inclined relative to the horizontal axis. In horizontal axis washing machines, the clothes are lifted by the rotating drum and then fall in response to gravity to form a tumbling action. Mechanical energy is imparted to the clothes by the tumbling action formed by the repeated lifting and dropping of the clothes. Vertical axis and horizontal axis machines are best differentiated by the manner in which they impart mechanical energy to the fabric items. The illustrated exemplary washing machine of FIG. 1 is a horizontal axis washing machine.

The washing machine 10 may include a cabinet 12, which may be a frame to which decorative panels are mounted. A controller 14 may be provided on the cabinet 12 and controls the operation of the washing machine 10 to implement a cycle of operation. A user interface 16 may be included with the controller 14 to provide communication between the user and the controller 14. The user interface 16 may include one or more knobs, switches, displays, and the like for communicating with the user, such as to receive input and provide output.

A rotatable drum 18 may be disposed within the interior of the cabinet 12 and defines a treating chamber 20 for treating laundry. The rotatable drum 18 may be mounted within an imperforate tub 22, which is suspended within the cabinet 12 by a resilient suspension system 24. The drum 18 may include a plurality of perforations 26, such that liquid may flow between the tub 22 and the drum 18 through the perforations 26. The drum 18 may further include a plurality of lifters 28 disposed on an inner surface of the drum 18 to lift a laundry load (not shown here) received in the laundry treating chamber 20 while the drum 18 rotates.

While the illustrated washing machine 10 includes both the tub 22 and the drum 18, with the drum 18 defining the laundry treating chamber 20, it is within the scope of the invention for either the drum 18 or tub 22 to define the treating chamber 20 as well as the washing machine 10 including only one receptacle, with the one receptacle defining the laundry treating chamber for receiving a laundry load to be treated.

A motor 30 is provided to rotate the drum 18. The motor 30 includes a stator 32 and a rotor 34, which are mounted to a drive shaft 36 extending from the drum 18 for selective rotation of the treating chamber 20 during a cycle of operation. It is also within the scope of the invention for the motor 30 to be coupled with the drive shaft 36 through a drive belt and/or a gearbox for selective rotation of the treating chamber 20.

The motor 30 may be any suitable type of motor for rotating the drum 18. In one example, the motor 30 may be a brushless permanent magnet (BPM) motor having a stator 32 and a rotor 34. Other motors, such as an induction motor or a permanent split capacitor (PSC) motor, may also be used. The motor 30 may rotate the drum 18 at various speeds in either rotational direction.

The washing machine 10 may also include at least one balance ring 38 containing a balancing material moveable within the balance ring 38 to counterbalance an imbalance that may be caused by laundry in the treating chamber 20 during rotation of the drum 18. The balancing material may be in the form of metal balls, fluid or a combination thereof. The balance ring 38 may extend circumferentially around a periphery of the drum 18 and may be located at any desired location along an axis of rotation of the drum 18. When multiple balance rings 38 are present, they may be equally spaced along the axis of rotation of the drum 18.

The washing machine 10 of FIG. 1 may further include a liquid supply and recirculation system. Liquid, such as water, may be supplied to the washing machine 10 from a water supply 42, such as a household water supply. A supply conduit 44 may fluidly couple the water supply 42 to the tub 22 and a treatment dispenser 46. The supply conduit 44 may be provided with an inlet valve 48 for controlling the flow of liquid from the water supply 42 through the supply conduit 44 to either the tub 22 or the treatment dispenser 46. The dispenser 46 may be a single-use dispenser, that stores and dispenses a single dose of treating chemistry and must be refilled for each cycle of operation, or a multiple-use dispenser, also referred to as a bulk dispenser, that stores and dispenses multiple doses of treating chemistry over multiple executions of one or more cycles of operation.

A liquid conduit 50 may fluidly couple the treatment dispenser 46 with the tub 22. The liquid conduit 50 may couple with the tub 22 at any suitable location on the tub 22 and is shown as being coupled to a front wall of the tub 22 in FIG. 1 for exemplary purposes. The liquid that flows from the treatment dispenser 46 through the liquid conduit 50 to the tub 22 typically enters a space between the tub 22 and the drum 18 and may flow by gravity to a sump 52 formed in part by a lower portion of the tub 22. The sump 52 may also be formed by a sump conduit 54 that may fluidly couple the lower portion of the tub 22 to a pump 56. The pump 56 may direct fluid to a drain conduit 58, which may drain the liquid from the washing machine 10, or to a recirculation conduit 60, which may terminate at a recirculation inlet 62. The recirculation inlet 62 may direct the liquid from the recirculation conduit 60 into the drum 18. The recirculation inlet 62 may introduce the liquid into the drum 18 in any suitable manner, such as by spraying, dripping, or providing a steady flow of the liquid.

The liquid supply and recirculation system may further include one or more devices for heating the liquid such as a steam generator 65 and/or a sump heater 63. The steam generator 65 may be provided to supply steam to the treating chamber 20, either directly into the drum 18 or indirectly through the tub 22 as illustrated. The inlet valve 48 may also be used to control the supply of water to the steam generator 65. The steam generator 65 is illustrated as a flow-through steam generator, but may be other types, including a tank type steam generator. Alternatively, the heating element, in the form of the sump heater 63, may be used to heat laundry (not shown), air, the rotatable drum 18, or liquid in the tub 22 to generate steam, in place of or in addition to the steam generator 65. The steam generator 65 may be used to heat to the laundry as part of a cycle of operation, much in the same manner as heating element 63, as well as to introduce steam to treat the laundry.

Additionally, the liquid supply and recirculation system may differ from the configuration shown in FIG. 1, such as by inclusion of other valves, conduits, wash aid dispensers, heaters, sensors, to control the flow of treating liquid through the washing machine 10 and for the introduction of more than one type of detergent/wash aid. Further, the liquid supply and recirculation system need not include the recirculation portion of the system or may include other types of recirculation systems.

Figure 2:
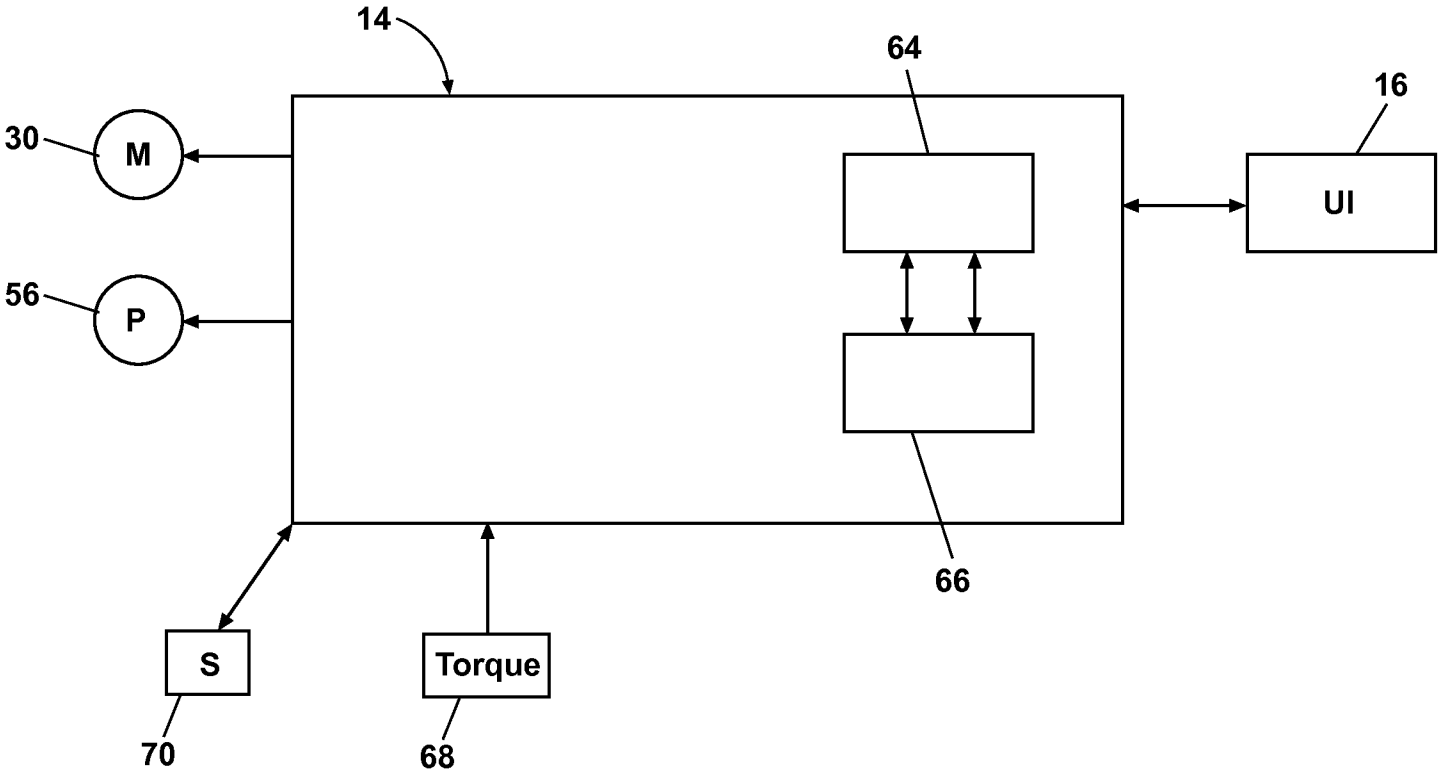
FIG. 2 is a schematic view of a controller of the laundry treating appliance of FIG. 1.

The controller 14 may be provided in the cabinet 12 and communicably couple one or more components to receive an output signal from components and control the operation of the washing machine 10 to implement one or more cycles of operation, which is further described in detail with reference to FIG. 2. The controller 14 may be provided with a memory 64 and a central processing unit (CPU) 66. The memory 64 may be used for storing the control software in the form of executable instructions that is executed by the CPU 66 in completing one or more cycles of operation using the washing machine 10 and any additional software. Additional software may be executed in conjunction with control software in completing a cycle of operation by the washing machine 10. For example, additional software may determine at least one of the torque, inertia, and acceleration of drum 18 with laundry within the treating chamber 20, based on the input from other components and sensors 68, 70 during a cycle of operation. The particular program is not germane to the invention.

The memory 64 may also be used to store information, such as a database or look-up table, or to store data received from one or more components of the washing machine 10 that may be communicably coupled with the controller 14 as needed to execute the cycle of operation.

The controller 14 may be operably coupled with one or more components of the washing machine 10 for communicating with and controlling the operation of the component to complete a cycle of operation. For example, the controller 14 may be coupled with the user interface 16 for receiving user selected inputs and communicating information with the user. The user interface 16 may be provided that has operational controls such as dials, lights, knobs, levers, buttons, switches, sound device, and displays enabling the user to input commands to a controller 14 and receive information about a specific cleaning cycle from sensors (not shown) in the washing machine 10 or via input by the user through the user interface 16.

The user may enter many different types of information, including, without limitation, cycle selection and cycle parameters, such as cycle options. Any suitable cycle may be used. Non-limiting examples include, Heavy Duty, Normal, Delicates, Rinse and Spin, Sanitize, and Bio-Film Clean Out.

The controller 14 may further be operably coupled to the motor 30 to provide a motor control signal to rotate the drum 18 according to a speed profile for the at least one cycle of operation, for controlling at least one of the direction, rotational speed, acceleration, deceleration, torque and power consumption of the motor 30.

The controller 14 may be operably coupled to the treatment dispenser 46 for dispensing a treating chemistry during a cycle of operation. The controller 14 may be coupled to the steam generator 65 and the sump heater 63 to heat the liquid as required by the controller 14. The controller 14 may also be coupled to the pump 56 and inlet valve 48 for controlling the flow of liquid during a cycle of operation.

The controller 14 may also receive input from one or more sensors 70, which are known in the art. Non-limiting examples of sensors that may be communicably coupled with the controller 14 include: a treating chamber temperature sensor, a moisture sensor, a weight sensor, a drum position sensor, a motor speed sensor, a motor torque sensor 68 or the like.

The motor torque sensor 68 may include a motor controller or similar data output on the motor 30 that provides data communication with the motor 30 and outputs motor characteristic information such as oscillations, generally in the form of an analog or digital signal, to the controller 14 that is indicative of the applied torque. The controller 14 may use the motor characteristic information to determine the torque applied by the motor 30 using a computer program that may be stored in the controller memory 64. Specifically, the motor torque sensor 68 may be any suitable sensor, such as a voltage or current sensor, for outputting a current or voltage signal indicative of the current or voltage supplied to the motor 30 to determine the torque applied by the motor 30. Additionally, the motor torque sensor 68 may be a physical sensor or may be integrated with the motor 30 and combined with the capability of the controller 14, may function as a sensor. For example, motor characteristics, such as speed, current, voltage, direction, torque etc., may be processed such that the data provides information in the same manner as a separate physical sensor. In contemporary motors, the motors 30 often have their own controller that outputs data for such information.

When the drum 18 with the laundry load rotates with a rotational axis of the drum 18 during an extraction phase, the laundry load may work as inertia to exert a centrifugal force on the drum 18. The force on the drum 18 is generally proportional to the inertia and/or rotational speed of drum 18.

Generally the motor torque for rotating the drum 18 with the laundry load may be represented in the following way:

$$\tau=J*\dot{\omega}+B*\omega+C \quad (1)$$

where, $\tau$=torque, J=inertia, $\dot{\omega}$=acceleration, $\omega$=rotational speed, B=viscous damping coefficient, and C=coulomb friction.

Traditionally the inertia of the laundry load may be determined during the extraction phase having at least one plateau phase. For example, the speed profile during the extraction phase may be configured to include two accelerations and one constant speed phase in the form of a plateau in-between two accelerations to determine the inertia of the laundry load in the following way:

During the plateau, the rotational speed may be maintained to be constant, and the resulting acceleration ($\dot{\omega}$) may be zero. Then, from equation (1), the torque may be expressed only in terms of $B*\omega$ in the following way:

$$\tau=B*\omega+C \quad (2)$$

Where the acceleration phase and the plateau meet, the torque would be assumed to be identical. Then, the equation may be solved for the inertia, assuming acceleration, rotational speed, viscous damping coefficient, and coulomb friction are known.

While the inertia may be determined for the extraction phase having at least one plateau, the inertia determined may not be applicable across the entire extraction phase as the inertia may vary with the progress in the extraction phase. As the inertia usually decreases during the extraction phase, the inertia determined from the profile having at least one plateau may be applicable only for a predetermined range of rotational speeds. Therefore, the inertia may need to be determined multiple times at different speed ranges, including upper rotational speed ranges, to provide upper inertia limit that may correspond to a force below a design force during extraction. Additionally, due to the presence of at least one plateau in the speed profile, the time period to reach the top extraction speed, and correspondingly the entire time period for the extraction phase may be delayed, resulting in the user dissatisfaction.

The invention addresses the problem by determining the inertia of the laundry load during an acceleration phase without any constant speed phase, which is accomplished by applying periodic signals to the acceleration profile. It has been observed that the inertia of the laundry load may be determined by applying a periodic torque signal to the acceleration profile to split the periodic signal into two ½ wave sections to solve for the inertia of the laundry load by cancelling out damping and friction forces.

Figure 3:
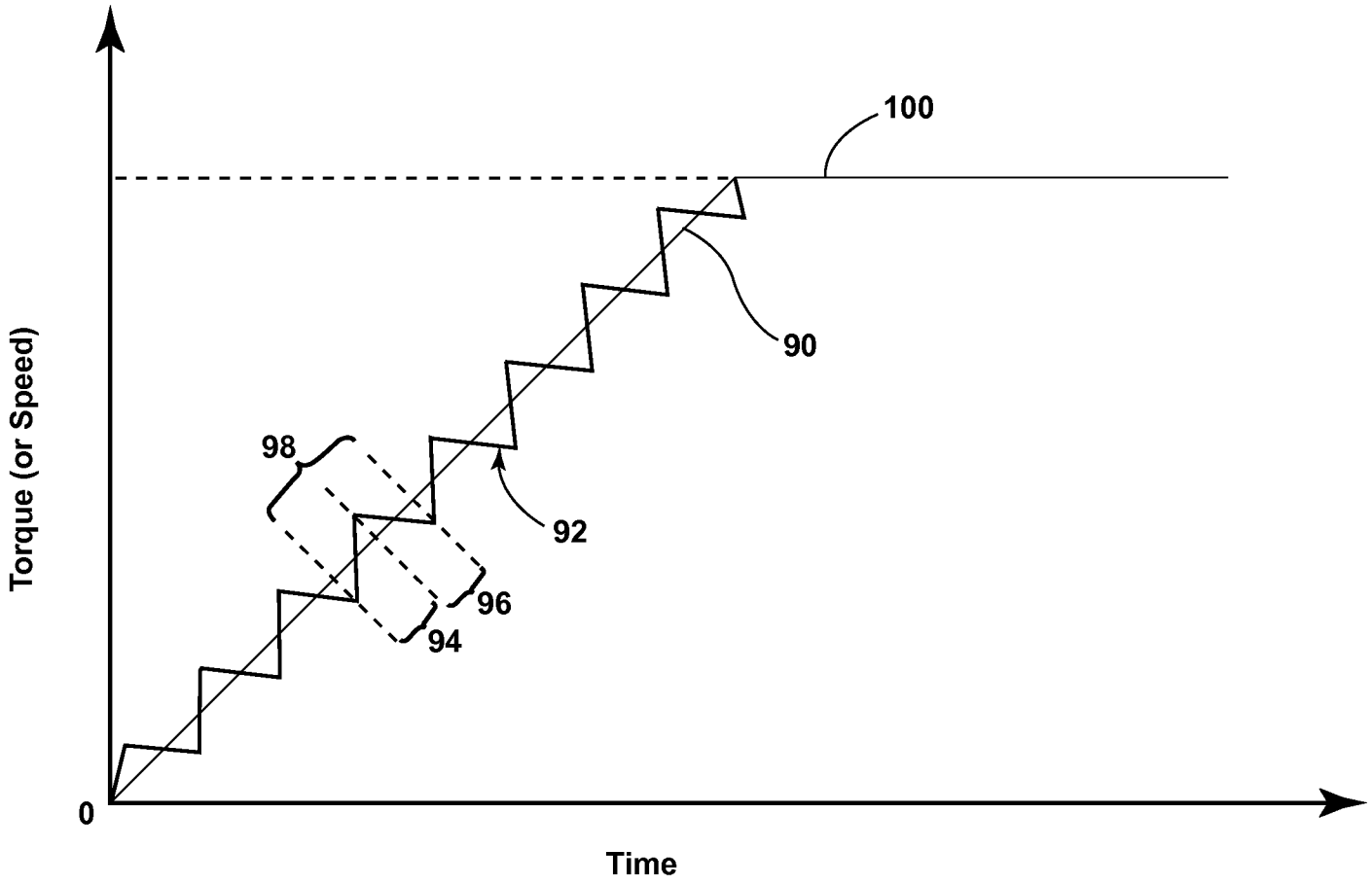
FIG. 3 is a plot of a saw tooth torque profile superimposed to the ramp profile of the drum during an acceleration phase, with the saw tooth profile to repeatedly determine the inertia of the laundry load during the acceleration phase in the laundry treating appliance of FIG. 1.

FIG. 3 illustrates a plot of a periodic torque signal applied to the speed profile of the drum 18 during an acceleration phase, with the periodic torque signal to repeatedly determine the inertia of the laundry load during the acceleration phase in the laundry treating appliance of FIG. 1.

The speed profile 90 may include an acceleration phase with no constant speed phase. For example, the speed profile 90 may be a linear function having constant acceleration. The speed profile 90 may be an extraction speed profile to remove the liquid from the laundry load in the treating chamber 20. The acceleration phase 90 may be configured to increase the rotational speed from a non-satellizing speed up to a satellizing speed 100, where the satellizing speed 100 may be a speed at which most of the laundry sticks to the interior drum wall due to centrifugal force. As used herein, the term satellizing speed refers to any speed where at least some of the laundry load satellizes, not just the speed at which satellizing is first observed to occur.

The satellizing speed 100 may refer to the greatest extraction speed during the extraction phase. The satellizing speed 100 may also be a greatest acceptable speed for a given inertia of the laundry load for which a force exerted on the drum shaft or drum may not exceed the corresponding design force.

The periodic torque signal 92 may be superimposed to the speed profile 90 to measure the inertia of the laundry load during an acceleration phase 90. The periodic torque signal may be provided in different ways. An imbalance of laundry in the treating chamber may induce the periodic torque or speed signal during the rotation of the treating chamber, without the need for forcing a periodic torque signal. Alternatively, if the torque or speed signal does not inherently have a periodic nature, one can be applied. A periodic signal may be actively formed in the torque or speed signal. This may be accomplished by the motor controller using a periodic waveform, such as a sine wave, as the basis for the acceleration ramp. Alternatively, a fixed ramp may be used and a periodic signal may be applied onto the fixed ramp. Regardless of where the periodic signals originated, it is observed that the inertia may be determined by this invention. It is only needed to determine the periodic waveform, which may be easier when the periodic waveform is applied as the periodic waveform will already be known.

For example, the torque from the motor 30 may be configured to repeatedly periodically increase and decrease by communicating with the motor torque sensor 68 and/or the controller 14. As a result, the resulting torque profile may be in the form of the saw tooth profile 92. The saw tooth profile 92 may be configured to be periodic, and may have a plurality of a single period 98. The single period 98 may include a first half period 94 and a second half period 96. The first half period 94 may correspond to an upward swing of the saw tooth profile 92. The second half period 96 may correspond to a downward swing of the saw tooth profile 92. The first half period 94 and the second half period 96 may be exactly alternatively symmetrical with respect to the speed profile 90.

According to the invention, it may be understood that the torque may be determined for each of the first and second half period, 94, 96. For example, the torque for first half period 94 and the second half period 96 may be determined respectively in the following way:

$$\tau_{first}=J^*\dot{\omega}+B^*\omega+C \quad (3)$$

$$\tau_{second}=J^*(-\dot{\omega})+B^*\omega+C \quad (4)$$

The difference between the torque of the motor 30 for a first half period 94 and the torque of the motor 30 for the second half period 96 may be represented in the following equation:

$$\tau_{first}-\tau_{second}=J^*\dot{\omega}+B^*\omega+C-(J^*(-\dot{\omega})+B^*\omega+C)=2^*J^*\dot{\omega} \quad (5)$$

If the equation (5) is solved for inertia, J:

$$J=(\tau_{first}-\tau_{second})/2^*\dot{\omega} \quad (6)$$

Both $\tau_{first}$ and $\tau_{second}$ may be determined by motor torque sensor 68 and/or controller 14, and the acceleration $\dot{\omega}$ may be a known value, such as the acceleration provided by the controller 14 to the motor 30, or may be determined by a suitable sensor. Therefore, the equation (6) may be solved for the inertia after superimposing each single period 98 of the periodic signal 92 to the speed profile 90 during an acceleration phase. The inertia may be updated after applying every single period 98 of the periodic signal 92. Alternatively, the inertia may be updated at a predetermined interval during an acceleration phase. For example, the inertia may be updated after completion of every two, three, or other multiple periods. It may be understood that the updated rate may also be adjusted by adjusting the frequency or amplitude of the periodic torque signal 92.

This invention of determining the inertia during the acceleration phase may be also applied in determining the final extraction speed 100. During the extraction phase, the laundry load may be fluidly coupled to the liquid that is provided to the treating chamber 20 to effect a cycle of operation. The liquid may be removed from the laundry load during the extraction phase to the exterior of the tub 22 by centrifugal force. As a result, the inertia of laundry load may decrease with time.

When the inertia of laundry load is maintained above a predetermined level for a given laundry load during the extraction phase, the inertia may create a stress on the drum shaft, or hoop stress on the drum 18 that exceeds the design maximum. Therefore, to keep the operation within the design maximums, at least one of the inertia and rotational speed may need to be controlled below a predetermined level such that the corresponding force exerted on the drum 18 may be less than the maximum design force of the drum 18.

It may be understood that controlling the rotational speed may be practically more effective than controlling the inertia during acceleration phase in the extraction phase. For example, the rotational speed of the drum 18 with the laundry load may be simply controlled by controlling the torque level input to the motor 30, while it may be demanding to adjust the inertia of the laundry load as the inertia of the laundry load generally dependent upon the rotational speed and time.

The maximum rotational speed, in the form of a final speed 100, of the drum 18 may be calculated in the following way: The maximum design force on the drum 18, together with the value of B and C, may be known for a given washing machine. The torque of the first and second half period of the periodic torque signal 92 from the motor 30 may be determined by the motor torque sensor 68 and/or controller 14. The acceleration may be also a known value. The inertia of the laundry load may then be repeatedly determined using the equation (6) during acceleration phase as described above.

Once the inertia is determined, the final speed 100 of drum 18 with the laundry may be calculated from equation (1). As the inertia is repeatedly updated, the final speed 100 of the drum 18 may be also repeatedly updated. Therefore, the drum 18 may be configured to continuously rotate below the final speed 18 during the acceleration, and any potential damage for the drum 18 may be prevented.

While the periodic signal may be in the form of a saw tooth torque profile, it may be noted that other periodic signals such as a sinusoid or any other periodic profile with an alternating symmetry relationship with respect to the speed profile may be also applied to the speed profile to repeatedly determine the inertia of the laundry load. For example, the sinusoid may be applied to the speed profile using a function or lookup table in the memory 64 in the controller 14.

The invention described herein provides a method to determine the inertia of the laundry load during an acceleration phase in the extraction phase. The method of the invention can be advantageously used in preventing the determining the inertia in a constant speed phase such as a plateau by applying a periodic signal on the speed profile. The difference between the torque of the motor for the first half period and the torque of the motor for the second half period may be calculated to solve for the inertia after completion of a period. The total time required to reach the satellizing speed may be shortened due to the absence of the constant speed phase. Further, by determining the inertia during the acceleration phase, the final speed of drum with laundry may be also repeatedly calculated to prevent an excessive force from being exerted on the drum during extraction above the design force.

While the invention has been specifically described in connection with certain specific embodiments thereof, it is to be understood that this is by way of illustration and not of limitation. Reasonable variation and modification are possible within the scope of the forgoing disclosure and drawings without departing from the spirit of the invention which is defined in the appended claims.

What is claimed is:

1. A method of operating a laundry treating appliance having a rotatable drum at least partially defining a treating chamber for receiving a laundry load for treatment according to at least one cycle of operation, and a motor rotating the drum, the method comprising:

rotating the drum according to a speed profile including an acceleration phase;

periodically varying the speed of the drum during the acceleration phase;

determining a torque during each period of varying speed; and repeatedly determining the inertia of the laundry load during the acceleration phase utilizing the torque determined during each period of varying speed.

2. The method of claim 1 wherein the acceleration phase comprises accelerating a rotational speed of the drum to a satellizing speed.

3. The method of claim 2 wherein the acceleration phase comprises accelerating the rotational speed of the drum from a non-satellizing speed to the satellizing speed.

4. The method of claim 3 wherein the satellizing speed comprises a greatest acceptable speed for the inertia of the laundry load.

5. The method of claim 4 wherein the speed profile is an extraction speed profile and the greatest acceptable speed comprises a greatest extraction speed.

6. The method of claim 4 wherein the greatest acceptable speed comprises a speed that does not apply a force to the drum, for the determined inertia during the acceleration phase, that exceeds a design force of the drum.

7. The method of claim 4 wherein the rotating the drum comprises the acceleration phase extending to the greatest acceptable speed without a constant speed phase.

8. The method of claim 1 wherein the periodically varying the speed comprises applying a periodic waveform onto an acceleration ramp during the acceleration phase.

9. The method of claim 1 wherein the periodically varying the speed comprises a first half period and a second half period and the repeatedly determining the inertia comprises determining a difference between the torque of the motor for a first half period and the torque of the motor for the second half period.

10. The method of claim 1 wherein the speed profile is a linear function having constant acceleration.

11. A method of operating a laundry treating appliance having a rotatable drum at least partially defining a treating chamber for receiving a laundry load for treatment according to at least one cycle of operation, and a motor rotating the drum, the method comprising:

rotating the drum according to a speed profile, which includes an acceleration phase that does not include a constant speed portion; and repeatedly determining the inertia of the laundry load during the acceleration phase.

12. The method of claim 11 wherein the repeatedly determining the inertia comprises periodically varying the speed of the drum during the acceleration phase.

13. The method of claim 12 wherein the periodically varying the speed comprises applying a periodic waveform onto an acceleration ramp during the acceleration phase.

14. The method of claim 12 wherein the periodically varying the speed comprises a first half period and a second half period and the repeatedly determining the inertia comprises determining a difference between the torque of the motor for a first half period and the torque of the motor for the second half period.

15. The method of claim 11 wherein the speed profile is a linear function having constant acceleration.

* * * * *